United States Patent [19]

Causse

[11] 4,228,862

[45] Oct. 21, 1980

[54] APPARATUS FOR DRILLING HOLES IN THE GROUND

[76] Inventor: Antoine Causse, 157, route de Blagnac, Toulouse (Haute-Garonne), France

[21] Appl. No.: 959,852

[22] Filed: Nov. 13, 1978

[30] Foreign Application Priority Data

Nov. 15, 1977 [FR] France ..... 77 34246

[51] Int. Cl.[2] ..... E21B 9/20

[52] U.S. Cl. ..... 175/242; 175/310; 175/404

[58] Field of Search ..... 175/101, 102, 105, 114, 175/171, 238, 241, 242, 245, 310, 311, 313, 316, 321, 323, 381, 404; 294/50.7

[56] References Cited

U.S. PATENT DOCUMENTS

| | | | |
|---|---|---|---|
| 521,175 | 6/1894 | Odewahn et al. | 175/242 X |
| 2,730,329 | 1/1956 | Jourdain | 175/316 X |
| 2,769,614 | 11/1956 | Zeni | 175/102 X |
| 2,873,950 | 2/1959 | Kandle | 175/321 X |
| 2,915,288 | 12/1959 | Crapez | 175/102 |
| 3,038,546 | 6/1962 | Blubaugh et al. | 175/316 X |
| 3,232,361 | 2/1966 | Haspert | 175/102 |
| 3,817,337 | 6/1974 | Panak et al. | 175/313 X |

FOREIGN PATENT DOCUMENTS

| | | | |
|---|---|---|---|
| 924237 | 4/1963 | United Kingdom | 175/267 |

*Primary Examiner*—James A. Leppink
*Attorney, Agent, or Firm*—Gerald J. Ferguson, Jr.; Joseph J. Baker

[57] ABSTRACT

The present invention relates to an apparatus for drilling holes in the ground. The apparatus comprises a cylindrical drilling tool having one end coupled to a motor assembly for rotating the tool by way of an elongate rotatable sleeve. A hydraulic jack is disposed in the sleeve for rotation therewith. The piston rod of the jack extends longitudinally of the drilling tool and carries a valve-action member arranged to allow drilled material to enter the drilling tool and to retain the material therein. The piston rod is movable longitudinally relative to said tool for the discharge of said material.

The apparatus of the invention is able to drill holes rapidly in a large variety of soils.

7 Claims, 4 Drawing Figures

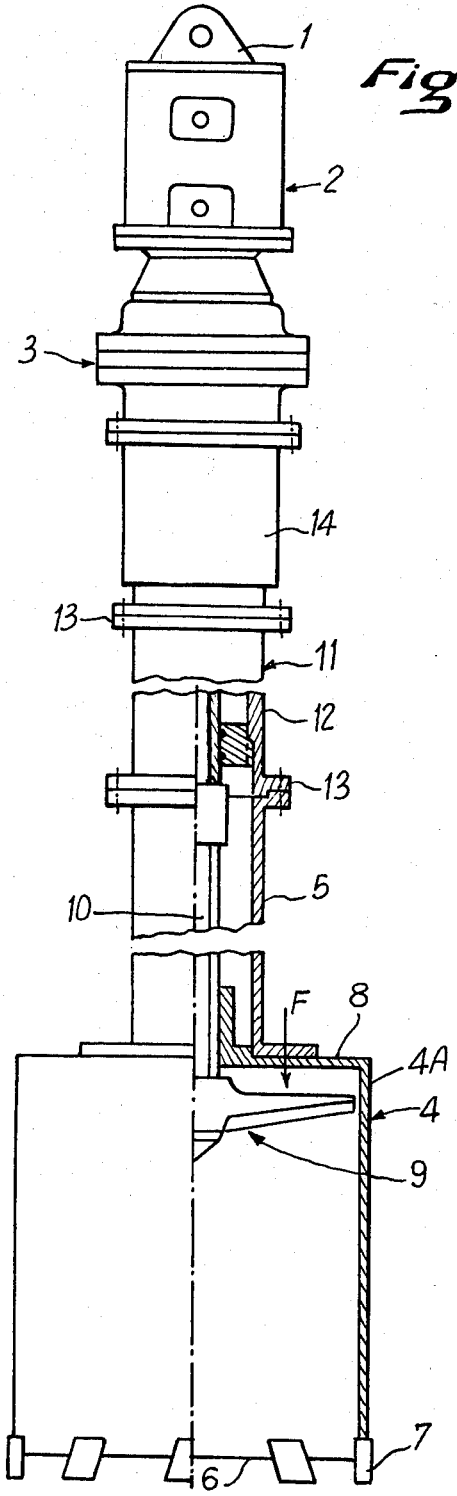
Fig:1
Fig:2
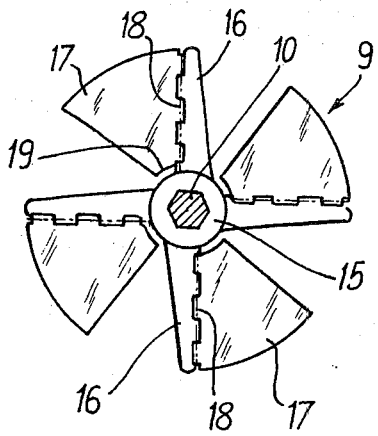

APPARATUS FOR DRILLING HOLES IN THE GROUND

BACKGROUND OF THE INVENTION

The invention relates to an apparatus intended for drilling holes, which are generally but not necessarily vertical, in the ground, for example to enable stakes to be implanted or foundation piles to be erected.

In order to drill regular holes in the ground more easily, rotating tools have been used which served to cut the ground and collect the debris so that it can be conveniently removed; examples of such tools include augers or drilling cylinders and bells.

SUMMARY OF THE INVENTION

The apparatus of the invention comprises a cylindrical hole-drilling tool having, at one open end, an attacking edge capable of penetrating into the ground and cutting a borehole.

It is an object of the invention to provide an apparatus of this kind which is capable of drilling holes in very different types of ground, from hard, resistant ground to soft ground with a tendency to crumble, by means of which the drilled material can readily be withdrawn from the hole and can also easily be removed from the drilling tool even if the ground is firm and cohesive.

According to the present invention there is provided apparatus for drilling holes in the ground comprising a cylindrical drilling tool having an upper end and a lower end, a drilling edge being provided at the lower end of said drilling tool, a motor assembly for rotating said drilling tool, a rotatable elongate sleeve coupling said motor assembly to said drilling tool, said sleeve being interposed between the motor assembly and the drilling tool and being keyed to the upper end of said drilling tool, a hydraulic jack disposed for rotation with said sleeve, the hydraulic jack having a piston rod which extends through the upper end of the drilling tool into the drilling tool and is longitudinally movable relative to said drilling tool, and means for closing and filling the drilling tool provided on the free end of said piston rod.

In a preferred embodiment of the invention, the elongate sleeve is formed, at least in its upper part, by the cylinder of the jack. The cylindrical tool is closed off at its upper end by a base which is fixedly connected to the rotational drive sleeve and has, in its centre, a guide aperture of suitable dimensions to ensure the longitudinal guiding of the piston rod of the jack.

BRIEF DESCRIPTION OF THE DRAWINGS

Embodiments of the present invention will hereinafter be described, by way of example, with reference to the accompanying drawings, wherein:

FIG. 1 is an elevation of apparatus of the invention with the lower part in partial section through a plane which passes through the axis, so as to show the interior of the drilling tool;

FIG. 2 is a partial view from above, in the direction of the arrow F of FIG. 1, of a valve-action member of the apparatus;

DESCRIPTION OF PREFERRED EMBODIMENTS

Figure 3:
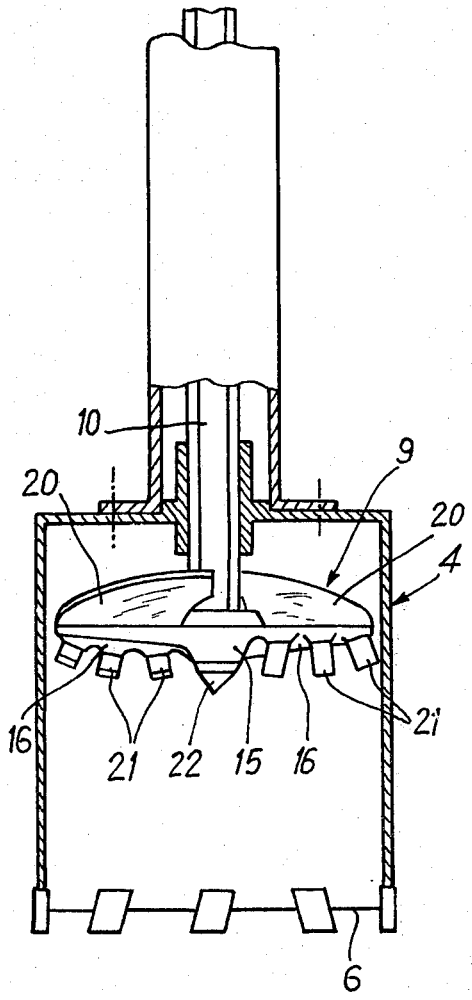
FIG. 3 is a partial section of a further embodiment of the invention showing the drilling tool and the valve-action member.

Apparatus of the invention may be constructed as an accessory for an existing, preferably hydraulic, machine such as a mobile crane, a hydraulic shovel, a drill with articulated or telescopic arms, etc. For this reason, there is provided, at its upper end, a fixing means 1 below which is attached the body of a hydraulic motor 2, or any other suitable motor, followed by a speed reducer 3. This reducing motor assembly serves to rotate a drilling tool 4 so as to drill a borehole as will be explained hereinafter.

One of several known means may be used for coupling the drilling tool 4 to the output shaft of the speed reducer 3. It is generally preferable to use a sleeve 5 which extends from one to the other and the length of which depends on the desired depth of the holes to be drilled.

The drilling tool 4 comprises a cylinder which is open at its lower end, where it terminates in an attacking edge 6 provided with teeth 7 which are preferably easy to replace when they wear out. The sleeve 5 may be coupled to the drilling tool 4 by various means. For example, the cylindrical wall 4 A of the tool 4 could be connected directly to the sleeve 5. However, as will become apparent, it is more convenient to provide the tool 4 with a base 8 opposite its attacking edge 6 and to fix the sleeve 5 to this base 8 by means of a flange assembly.

According to the invention, a member 9 acting as a valve is arranged inside the drilling tool 4 so as to be longitudinally movable therein from the base 8 to a point outside the tool 4, beyond the attacking edge 6. In order to provide this longitudinal translation of the member 9, the valve-action member 9 is mounted on the end of a rod 10 which in turn slides within the tool 4. When a base 8 is provided, the rod 10 passes through it and is thus guided in its movement.

The rod 10 may be manoeuvred by any known means, and is preferably the longitudinally extending piston rod of a hydraulic jack 11 arranged above the drilling tool 4. Of course, the jack 11 may be housed within the sleeve 5 but it is preferable for the jack 11 itself to form part of the sleeve 5. For this purpose, the cylinder 12 of the jack 11 is provided with flanges 13 at both ends so as to be mounted to provide an extension of the sleeve 5. This jack 11 is a double-action jack, with a simple action or a telescopic action, as required. When the jack 11 is mounted coaxially with the drilling tool 4, as has just been explained, its cylinder 12 serves to effect rotational driving of this tool. For this reason, a rotary joint 14 is interposed between the jack 11 and the speed reducer 3 so as to ensure an unobstructed supply of fluid under pressure.

It is not essential for the valve-action member 9 to be rotated, the present invention is also applicable to embodiments where this member 9 is only movable in translation. However, it is more advantageous, as in the embodiment shown in FIG. 1, for the member 9 to rotate at the same time as the drilling tool 4. In this embodiment, rotation of the member 9 is caused by rotation of the jack 11. However, it is preferable for the rod 10 which passes through the base 8 to have a cross sectional profile which is circular, e.g. to have an hexagonal profile as shown in FIG. 2, so that rotation of the base 8, which has a corresponding aperture for the passage and guiding of the rod 10, rotates the said rod.

The valve-action member 9 may be constructed in several ways which the man skilled in the art can adapt to suit the special nature of the ground which is to be drilled. The essential function of the member 9 is to allow fragments and particles of the drilled material to enter inside the drilling tool 4 whilst the tool 4 is being plunged into the ground and to prevent this material from accidentally falling out when the tool is withdrawn from the hole. Subsequently, outside the hole, the member 9 allows or positively causes this material to be discharged from the drilling tool 4.

The valve-action member 9 shown in FIG. 2 comprises a hub 15 from which a plurality of radial arms 16 spaced in a circle extend. Each arm 16 carries a flap 17 disposed in the space between two adjacent arms. Each flap 17 is pivotally mounted at 18 to its respective arm 16 and may be pivoted from a blocking position in which it extends transversely of the drilling tool 4 upwardly towards the base 8. Thus, as the drilling tool 4 is operating fragments of the material being drilled push back the flaps 17 and pass into the drilling tool 4 but cannot escape therefrom. The jack 11 enables the material within the tool 4 to be compressed so as to ensure better filling of the tool 4. In the embodiment illustrated in FIG. 2, the flaps 17 do not completely fill the spaces between the arms 16. The need for more or less total blocking of these spaces depends on the nature of the material being drilled. Sandy soil may require almost total blocking.

Instead of being pivotally mounted by means of one of their radially extending edges, the flaps 17 could be pivotally mounted by their circumferential edge 19 close to the hub 15. Pivotal mounting of the flaps is not obligatory; fixed but flexible blades could be used to achieve the same result. It should be understood that the invention covers all possible equivalents in this respect.

In a second embodiment of the valve-action member 9 shown in FIG. 3, there are again radial arms 16 extending from the hub 15, but the flaps are replaced by a spiral 20 extending helically from each arm 16 towards the interior of the drilling tool 4. Each spiral 20 covers the entire radial length of the arms 16 and is developed over a fraction of the circumference, e.g. a quarter when four arms are provided.

Figure 4:
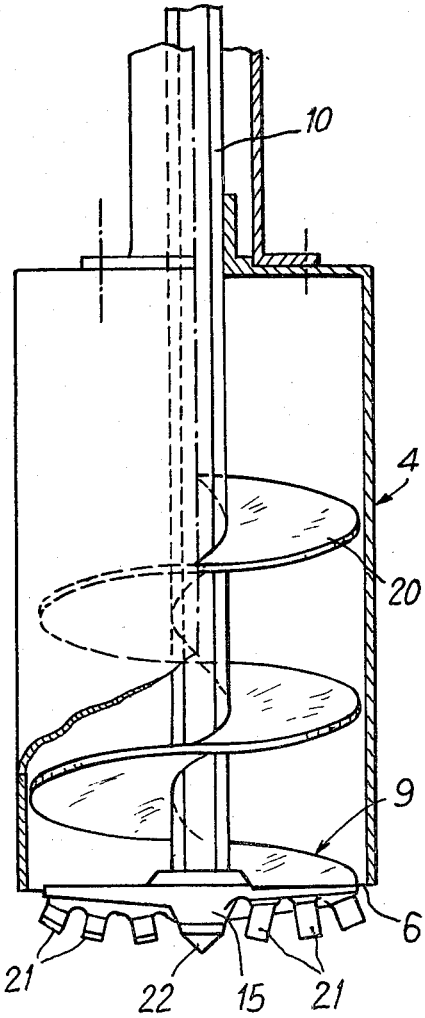
FIG. 4 is a partial section, analogous to FIG. 3, showing an alternative construction of the drilling tool and valve-action member.

Of course, the invention does not impose any restrictions on the size of the spiral 20. As shown in FIG. 4, it may be developed over a number of turns and in this case starts from only one of the arms 16. During rotation of the valve-action member 9, the drilled material may penetrate inside the drilling tool 4; in fact the material is actually driven into the tool 4 by the screwing action of the spiral 20 and is compressed therein, thus ensuring that the tool 4 is properly filled. When rotation of the member 9 ceases, the drilled material cannot fall out, of the tool 4, particularly if the spiral 20 has a shallow pitch. To empty the tool 4, rotation of the member 9 in the reverse direction may be effected by means of the motor 3, so that the spiral 20 drives the material out of the tool 4, or else the member 9 may be pushed downwards by means of the jack 11 beyond the attacking edge 6 and outside the drilling tool 4.

It will be apparent that the valve-action member 9 has to be adapted to the nature of the ground being drilled; the spiral 20 in FIG. 4 is highly suitable for sandy soils. If the ground in question is clay and tends to compact, the apparatus according to the invention may be used by placing the member 9 within the drilling tool 4 adjacent the base 8, as shown in FIG. 1. With a sticky material, the material drilled adheres to the inside of the tool 4 without having to be held in place. To make this soil fall out at the proper time, the member 9 is used as a piston by pushing it towards the edge 6 of the tool 4 by means of the jack 11.

The construction of the member 9 with radial arms is not essential, as has already been stated; however, it is advantageous to provide these arms 16, since they each have an outer surface, i.e. a surface facing the outside of the drilling tool 4. Teeth 21 for penetrating into the ground to be drilled may be attached to this outer surface. Thus, if the ground is stoney or rocky or simply very compact, the teeth 21 on the member 9 break it up by rotation and the debris is conveyed and compressed by the spiral 20 inside the drilling tool 4 whilst the tool is entering the ground. The hub 15 preferably terminates in a lower point 22 which ensures that the drilling tool 4 is centred.

I claim:

1. Apparatus for drilling holes in the ground comprising a cylindrical drilling tool having an upper end and a lower end, a drilling edge being provided at the lower end of said drilling tool, a motor assembly for rotating said drilling tool, a rotatable elongate sleeve coupling said motor assembly to said drilling tool, said sleeve being interposed between the motor assembly and the drilling tool and being keyed to the upper end of said drilling tool, a hydraulic jack disposed for rotation with said sleeve, the hydraulic jack having a piston rod which extends through the upper end of the drilling tool into the drilling tool said piston rod being longitudinally movable relative to said drilling tool, and means for closing and filling the drilling tool provided on the free end of said piston rod.

2. Apparatus according to claim 1, wherein the hydraulic jack has a cylinder, and at least part of the elongate sleeve is formed by said cylinder.

3. Apparatus according to claim 1, wherein an upper end surface closes the upper end of said drilling tool, said upper end surface being fixedly coupled to said elongate sleeve, and wherein a guide aperture is provided centrally of said end surface through which said piston rod passes, said piston rod being longitudinally guided by said guide aperture.

4. Apparatus according to claim 3, wherein the guide aperture has a non-circular cross-section, and wherein at least the part of the piston rod which passes through the guide aperture has a corresponding cross-section whereby rotation of said upper end surface rotates said piston rod.

5. Apparatus according to claim 1, wherein said means for closing and filling the drilling tool comprises a hub carried on the free end of said piston rod, a plurality of angularly spaced arms extending radially from said hub, and a plurality of flaps arranged between adjacent arms and movable towards the upper end of the drilling tool.

6. Apparatus according to claim 5, wherein each flap is hingedly connected to a respective arm.

7. Apparatus according to claim 1, wherein said means for closing and filling the drilling tool comprises a hub carried on the free end of said piston rod, a plurality of angularly spaced arms extending radially from said hub, and at least one spiral carried by one of said arms and developed over at least one turn towards the upper end of the drilling tool.

* * * * *